US009139258B2

(12) United States Patent
Russikoff

(10) Patent No.: US 9,139,258 B2
(45) Date of Patent: Sep. 22, 2015

(54) PULLOUT SHADE SYSTEM FOR BOATS

(71) Applicant: Ronald K. Russikoff, Philadelphia, PA (US)

(72) Inventor: Ronald K. Russikoff, Philadelphia, PA (US)

( * ) Notice: Subject to any disclaimer, the term of this patent is extended or adjusted under 35 U.S.C. 154(b) by 0 days.

(21) Appl. No.: 13/815,247

(22) Filed: Feb. 13, 2013

(65) Prior Publication Data

US 2013/0206050 A1 Aug. 15, 2013

Related U.S. Application Data

(60) Provisional application No. 61/633,584, filed on Feb. 14, 2012.

(51) Int. Cl.
*B63B 17/02* (2006.01)

(52) U.S. Cl.
CPC ..... *B63B 17/02* (2013.01)

(58) Field of Classification Search
CPC .. B63B 17/02; E04F 10/0625; E04F 10/0614; E04F 10/0603
USPC ..... 114/361; 160/71; 135/88.11, 88.12
See application file for complete search history.

(56) References Cited

U.S. PATENT DOCUMENTS

| | | | | |
|---|---|---|---|---|
| 2,079,073 | A * | 5/1937 | Knoll | 160/22 |
| 3,918,510 | A * | 11/1975 | Hayward | 160/45 |
| 5,924,465 | A * | 7/1999 | Malott | 160/67 |
| 7,571,691 | B2 * | 8/2009 | Russikoff | 114/361 |

* cited by examiner

*Primary Examiner* — Edwin Swinehart
(74) *Attorney, Agent, or Firm* — Armand M. Vozzo, Jr.

(57) ABSTRACT

A manually operated boat shade system is disclosed for deploying a flexible canvas or like shade material over the deck of a boat solely by hand. The device is adapted to mount as an integral unit to overhead structure on the boat and comprises a pair of tubular actuator assemblies telescopically assembled and coupled together in parallel alignment within a self-supporting framework to permit pullout deployment and reverse retraction of the flexible canvas from a tensioned roller member transversely mounted between the actuator assemblies. A self-engaging locking mechanism is further incorporated within the tubular actuator assembly to maintain the framework when in full extension preventing an unwanted retraction. The locking mechanism is further releasable by hand to allow a staged retraction of the framework and canvas when desired.

12 Claims, 5 Drawing Sheets

PULLOUT SHADE SYSTEM FOR BOATS

CROSS-REFERENCE TO RELATED APPLICATION

This application is a continuation-in-part of provisional patent application Ser. No. 61/633,584 filed Feb. 14, 2012 for Pullout Shade System for Boats.

BACKGROUND OF THE INVENTION

The present invention relates to retractable canopy systems for boats, and more particularly to a manually operated boat shade system comprising a pair of telescoping tubular actuators connected in parallel alignment within a self-supporting framework to permit pullout deployment of a flexible canvas by hand, and a releasable locking mechanism incorporated within the tubular actuators that serves to maintain the framework in full extension preventing an unwanted retraction thereof and further allowing a staged retraction when desired.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. While deployment of these folding type bimini tops was often done manually, some were designed to be automated in their operation, the latter requiring electrical power, such as those described in U.S. Pat. No. 6,209,477 to Briedenweg and U.S. Pat. No. 6,983,716 to Ankney et al. Regardless of their specific foldable structure or method of operational deployment, the installation and utilization of bimini tops have became increasingly important for the protection of passengers and crew on board boats against excessive sun exposure and the known risks of skin cancer caused thereby.

While providing effective sunshade protection, the assembled structure of these folding bimini top arrangements, typically including a plurality of poles or bow-like members pivotally mounted across the boat deck, would often obstruct a person on board from reaching out over the side of the boat when fishing, docking or mooring the boat and further present an obstacle in boarding and loading equipment onto the deck. To overcome these obstacles and still provide effective sunshade protection, retractable canopy systems were devised and developed as retrofits for recreational boats capable of operative attachment to existing overhead structure on the boat without causing obstructions upon the deck. As retrofits, such retractable canopy systems were designed to mount onto existing rooftop members set over the deck of a boat or upon other elevated structures, such as radar arches or towers. These prior art retrofit canopy systems include those designed to be manually operated, such as those described in U.S. Pat. Nos. 4,951,594 to Feikama and 6,439,150 to Murphy et al., and those designed to be automated in their operation, such as those described in U.S. Pat. Nos. 7,571,691, 7,895,964 and 7,950,342 to Ronald K. Russikoff. These latter automated systems have featured a telescopic framework or so-called "teleframe" design that mounts directly to a rooftop or other overhead structure on the boat without need for side-supporting poles thereby easing the handling of dock lines and boarding of the boat and providing clear unobstructed views while on board. While these prior art canopy systems have been generally satisfactory in their intended manual or automated deployment upon boats, some drawbacks have arisen in their implementation and usage. The automated systems, for example, while providing relatively quick and easy deployment in a self-supporting framework, are rather burdensome in the weight of their assembled components, particularly those involved in their powered operation, and further in amount of retrofit labor involved in the mounting and routed connections these automated systems require. The manual systems, on the other hand, while being generally lighter in weight and more simple in their retrofit attachments than the automated systems, have been somewhat limited in their operational deployment upon certain smaller, relatively lightweight recreational boats that have limited overhead surface areas, such as T-top center console fishing boats, bow rider boats, and wake board boats. These smaller recreational boats require a more compact and lightweight retractable canopy device that will better accommodate their limited overhead surface areas and better fit with their existing structure than prior art canopy systems of either manual or automated operation.

Accordingly, there is a need for an improved retractable canopy system for recreational boats that is completely manual in its operation and compact in its structure and can be easily mounted and safely deployed on virtually any style boat. Furthermore, there is an associated need for such a manually operated boat shade system that is relatively inexpensive to make and assemble and affordable to a substantial number of boat owners.

SUMMARY OF THE INVENTION

Accordingly, it is a general purpose and object of the present invention to provide an improved retractable shade system for boats that is simple to operate and easily installed upon a variety of boats for providing extended sunshade protection to those on board the boat without causing obstructions upon the deck.

A more particular object of the present invention is to provide an improved retractable shade system more suited for smaller recreational boats that is lightweight and completely manual in its operation and easy to deploy by those on board whenever extended sunshade protection is needed and without obstructing the movement or performance of those on or around the deck.

Another object of the present invention is to provide an improved manually operated retractable boat shade system that is self-supporting in its assembled structure and readily mountable to any overhead structure that may exist or be erected upon the deck of the boat to furnish needed sunshade protection to those on board.

Still another object of the present invention is to provide an improved manually operated boat shade system that is safe and reliable to use regardless of whether the boat is resting in calm water or moving about on high seas.

A further object of the present invention is to provide an improved manually operated boat shade device that is relatively inexpensive to manufacture, assemble and install in an integrated working unit affordable to a substantial number of boat owners.

Briefly, these and other objects are accomplished by an improved manually operated boat shade system for deploying a flexible canvas or like shade material over the deck of a boat solely by hand. The system is adapted to mount as an integral unit to overhead structure on the boat and comprises a pair of tubular actuator assemblies each telescopically assembled and coupled together in parallel alignment within a self-supporting framework to permit pullout deployment and reverse retraction of the flexible canvas from a tensioned roller member transversely mounted between the actuator assemblies. A self-engaging locking mechanism is further incorporated within the tubular actuator assemblies to maintain the framework when in full extension preventing an unwanted retraction. The locking mechanism is further releasable by hand to allow a staged retraction of the framework and canvas when desired. Sleeve members disposed between the respective tubes provide bearing surfaces that stabilize their telescoping movement and intermediate cross bars support the framework and the flexible canvas during deployment and full extension.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

Figure 1:
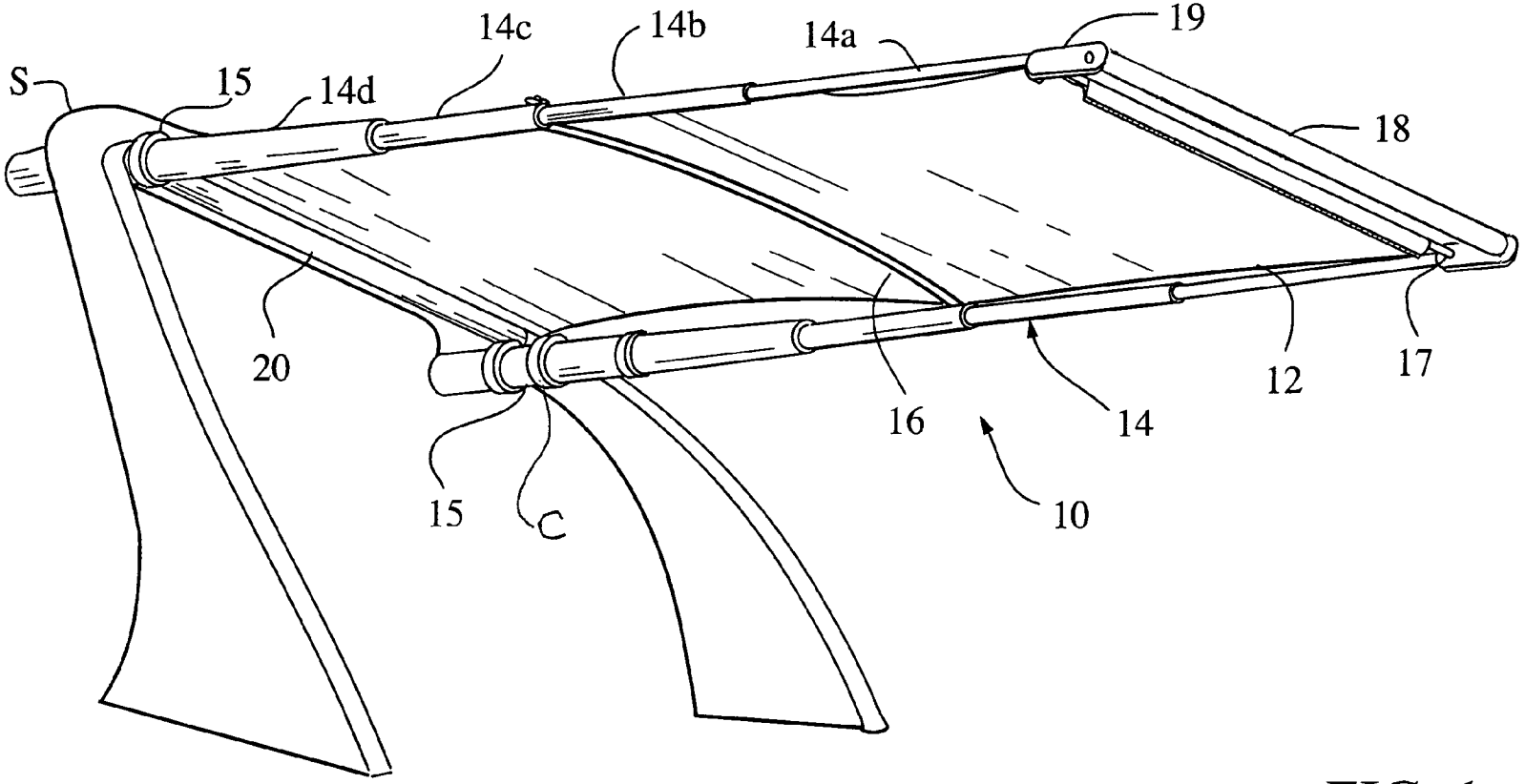
FIG. 1 is a perspective view of a manually operated boat shade system made in accordance with the present invention and shown in extended deployment mounted upon elevated boat structure.

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Referring to the drawings, the following is a list of structural elements of the present manually operated boat shade device, generally designated 10, and those associated elements shown employed in connection with the present invention:

10 boat shade system;
12 canvas;
14 tubular actuator assembly;
14*a* first stage tubular member;
14*b* second stage tubular member;
14*c* third stage tubular member;
14*d* fourth stage tubular member;
15 stationary rearward tubular member;
15*a* end cap;
16 intermediate crossbar;
17 forward crossbar;
18 handle bar;
19 extension plate;
20 tensioned roller member;
22 front cap;
24 actuator lever member;
24*a* actuator slot;
26 actuator shaft;
28 unlocking lever member;
28*a* angled post;
30 first end cap assembly;
32 end cap member;
32*a* end cap post;
32*b* end cap guide;
32*c* end cap chamber;
34 locking pin;
34*a* angled slot;
36 compression spring;
38 forward bearing sleeve;
40 second end cap assembly;
40*a* second end cap post;
50 third end cap assembly;
50*a* third end cap post;
60 fourth end cap assembly;
60*a* fourth end cap post;
C mounting clamps; and
S overhead structure.

Referring now to FIG. 1, a preferred embodiment of the present boat shade system, generally designated 10, is shown mounted upon overhead structure S in an extended deployment of the system. Designed for pullout extension and reverse retraction by hand and intended to provide sunshade protection for boat passengers, the present boat shade system 10 comprises a pair of tubular actuator assemblies 14 telescopically assembled and combined in parallel alignment to deploy a flexible canvas material 12 from upon a tensioned roller member 20 of a conventional torsion spring design that is transversely mounted for rotation between the respective actuator assemblies at the rearward end thereof. Generally cylindrical in form, each tubular actuator assembly 14 includes a rearward tubular member 15 closed at its back end and a series of separate movable tubular members: first stage member 14*a*, second stage member 14*b*, third stage member 14*c* and fourth stage member 14*d*, each sized in their respective lengths and diameters to fit together and into the rearward tubular member in telescopic stages. Accordingly, first stage tubular member 14*a* slides longitudinally within second stage tubular member 14*b*, which slides longitudinally within third stage member 14*c*, which slides longitudinally within fourth stage member 14*d*, which together with the other stage members, slides into the stationary rearward tubular member 15. All members of the tubular actuator assemblies 14 are generally made of relatively strong and durable materials that are particularly resistant to corrosion, including metals, such as aluminum, aluminum alloys, and stainless steel and synthetic thermoplastics, such as nylon. In the cylindrical embodiment of the tubular actuator assemblies 14, the component tubular members 14*a*, 14*b*, 14*c*, 14*d* and 15 should be guided during their relative telescopic movement and made to resist any relative rotation, preferably by a rail or strip internally placed along the top of the respective tubular members, so that proper alignment of the internal elements of the releasable locking mechanism is maintained.

The rearward tubular member 15 is designed to be the stationary member in the mounted tubular actuator assembly 14 and serves as the base for mounting the present boat shade system 10 to the overhead structure S. Conventional C-shaped mounting clamps C, typically a pair for each tubular actuator assembly 14, are adapted to fit about and engage the circumference of the rearward tubular member 15 and provide a means for attaching the rearward tubular member and associated structure of the actuator assemblies to the overhead structure S on port and starboard sides using conventional mechanical fasteners. The rearward tubular members 15 are mounted to the overhead structure S substantially parallel to each other and positioned longitudinally on each side beneath the tensioned roller member 20 transversely disposed at the rear of the boat shade system 10. In the mounted setting of the present boat shade system 10, the tensioned roller member 20 is preferably set horizontally in close proximity above the rearward tubular members 15 and alongside the rearward edge of the overhead structure S.

The canvas material 12 is cut and finished in an extended sheet having a width intended to substantially span the space between the tubular actuator assemblies 14. One end of the canvas material 12 is fastened along its edge to the surface of the tensioned roller member 20, typically across the roller member surface using a conventional mechanical fastener, and the remaining length of the canvas material is wrapped around the roller member a sufficient number of times. The opposite or outside end of the canvas material 12 is adapted to be releasably fastened along its edge to a forward crossbar 17 that is transversely mounted between the tubular actuator assemblies 14 at the forward ends thereof. An intermediate coupling strip, such as one incorporating zipper engagement, may be used to releasably fasten the outer edge of the canvas material 12 to and about the forward crossbar 17. An extension plate 19 attached to the front end of each of the first stage tubular members 14*a* on both sides of the framework is made to extend forward therefrom and adapted to secure opposite ends of the forward crossbar 17 sufficiently to support the forward crossbar in holding the outside end of the canvas material 12.

A handle bar 18 is transversely positioned substantially parallel to the forward crossbar 17 and similarly mounted between the extension plates 19 at the forwardmost end of the structural framework of the present boat shade system 10. The handle bar 18 is sufficiently sized and shaped to comfortably grip with one or both hands of the user and is used to apply pulling and pushing forces intended to extend and retract the tubular actuator assemblies 14 and the associated canvas material 12 thereon. Pulling force applied to the handle bar 18 extends the actuator tube assemblies 14 and serves to draw the canvas material 12 from the tensioned roller member 20 allowing its full deployment as shown in FIG. 1, while a pushing force applied to the handle bar in conjunction with a levered release of an internal locking mechanism, which is described in greater detail below, will allow a staged retraction of the extended framework and the canvas material when desired. An intermediate crossbar 16 transversely mounted between the actuator tube assemblies 14 near the middle of their extended lengths is connected across the front ends of the third stage member 14*c* to further support the extended structure and the canvas material 12 in full deployment.

Figure 2:
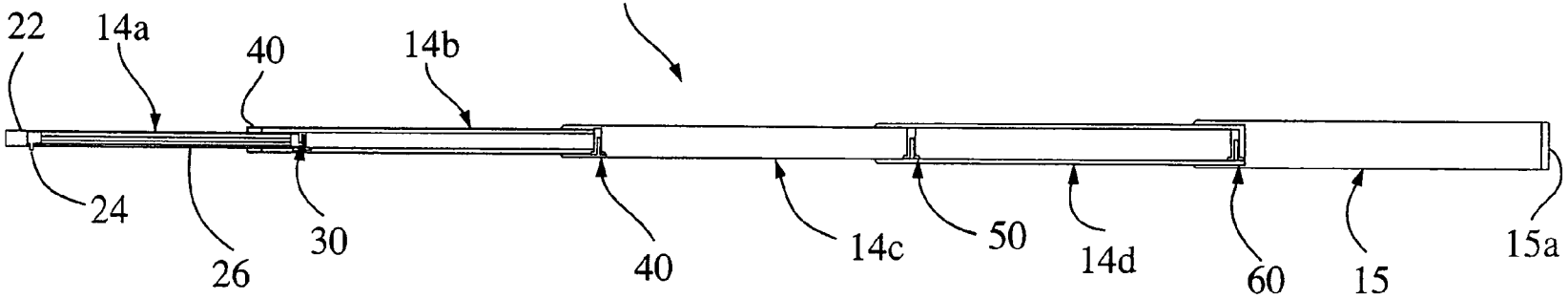
FIG. 2 is a longitudinal plan view of one of the pair of tubular actuator assemblies used in the present boat shade system of FIG. 1 and shown in its fully extended state with portions cut away along the length.
Figure 2A:
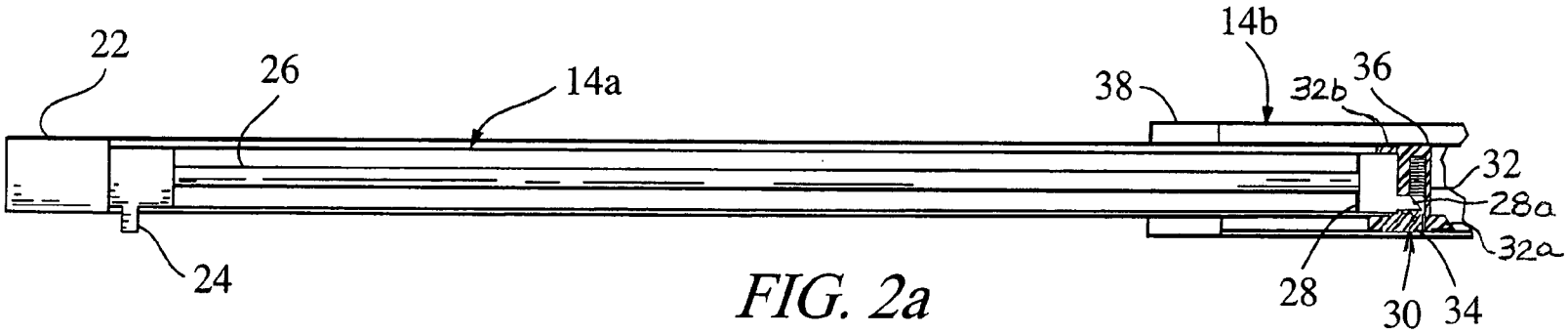
FIG. 2*a* is an enlarged longitudinal view of the front portion of the extended tubular actuator assembly of FIG. 2 showing the internal engagement of the first and second stage tubular members as the members are retracted in accordance with the present invention.

Referring now to FIGS. 2 and 2*a* in conjunction with FIG. 1, each tubular actuator assembly 14 incorporates an internal self-locking mechanism that comprises an actuator lever member 24 positioned near the front of the first stage tubular member 14*a* and projecting through a slot 24*a* therein, an actuator shaft 26 attached to the lever member at one end and made to extend longitudinally through the first stage tubular member, an unlocking lever member 28 attached to the other end of the shaft having an extended post 28*a* projecting rearward therefrom, and a specially designed end cap assembly 30 attached to the back end of the first stage tubular member 14*a*. The end cap assembly 30 further comprises an end cap member 32 formed having an extended post 32*a* with an angled wedge-like surface projecting rearward along the base of the member, a guide strip 32*b* projecting forward along the top of the member, and a vertical chamber 32*c* wherein a specially formed locking pin 34 and coiled compression spring 36 are disposed and engaged in a spring-loaded assembly. The end cap member 32 is also provided with a slot opening on its forward wall that extends through to the vertical chamber 32*c*, the forward opening being formed and positioned to allow passage of the extended post 28*a* of the unlocking member 28 into and out of the vertical chamber.

Each end cap member 32 is made from a thermoplastic material having high durability and bearing qualities, such as nylon, that is molded in its described form and, in its attachment, further acts as a bearing and guide to center the movement of the first stage tubular member 14*a*. A sleeve member 38 made from a similar thermoplastic material is formed to insert onto the front end of the second stage tubular member 14*b* and is made to attach thereto to serve as an internal bearing to promote the telescopic movement of the first stage tubular member 14*a* and a guide to center its movement through the second stage member. Additional bearing sleeves similar to sleeve member 38 but each slightly larger in diameter are respectively attached to the front end of each successive stage tubular members 14*c*, 14*d* as well as the rearward tubular members 15 to promote sliding interaction and the associated telescopic movement of the members.

Locking pin 34 is sized in length and diameter to fit within the vertical chamber 32*c* of the end cap member 32 and allow the pin to move axially therein in opposite directions. The coiled compression spring 36 is similarly sized to fit within the vertical chamber 32*c*, its outer diameter being sufficient to allow a close fit without restriction of its working coils and its length being sufficient to fit substantially within the upper half of the chamber. The locking pin 34 is normally biased and urged downward and outward from the vertical chamber 32*c* by its spring-loaded engagement with the coiled compression spring 36 so that the lower tip of the locking pin engages an associated hole opening near the front and along the bottom of the second stage tubular member 14*b* thereby locking the position of the second stage member relative to the first stage member 14*a*. It should be noted and understood that this normally biased engagement of the spring-loaded locking pin 34 produced by the working effect of the end cap assembly 30 is effectively repeated through the remaining moving tubular stages 14*c* and 14*d* and the stationary tubular member 15 when the tubular actuator assembly 14 is fully extended, as shown in FIG. 2, with respective end cap assemblies 40, 50 and 60 similarly assembled and secured to the ends of the second, third and fourth stage tubular members.

While being generally cylindrical, the locking pin 34 is further formed and fabricated having an angled cutout section 34*a* about midway along its length. The angled cutout section 34*a* is made to conform to the angled, wedge-like surface projecting from the extended post 28*a* of unlocking member 28 and is disposed to face in a forward direction on the chambered locking pin to permit cooperative engagement with the reward projecting extended post 28*a*. Shown more clearly in FIG. 4 and described in greater detail below, the cooperative engagement and interaction of the extended post 28*a* with the cutout section 34*a* of the locking pin 34 as the unlocking member 28 moves rearward upon the actuator shaft 26 will cause the locking pin to retract sufficiently into the vertical chamber 32*c* of the end cap member 32 and release it from engagement with the associated hole opening in the bottom of the second stage tubular member 14*b*. As better seen in FIG. 5, this same unlocking effect is produced progressively in the remaining tubular members 14*c*, 14*d* and 15 by the rearward motion of the respective end cap assemblies 40, 50 and 60 and their respective engagements.

Figure 3:
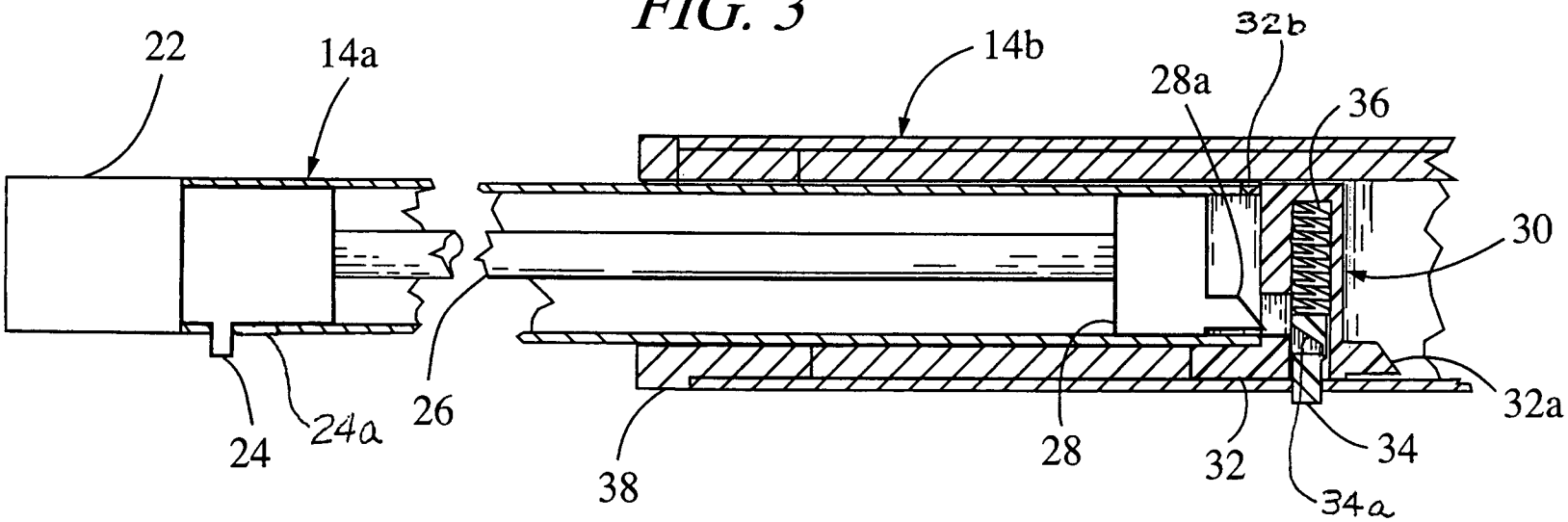
FIG. 3 is an enlarged longitudinal view partially sectioned and cut away of the front end portion of the extended tubular actuator assembly shown in FIG. 2.

Referring now to FIG. 3 in conjunction with FIGS. 1 and 2, the first stage tubular member 14*a* is fully extended within the actuator assembly 14 and immediately projecting from the second stage tubular member 14*b* with the actuator lever 24 forward in slot 24*a* and the unlocking lever member 28 with its extended post 28*a* forward and removed from the end cap assembly 30 at the rearward end of the first tubular member. In this extended state, the spring-loaded locking pin 34 within the vertical chamber 32*c* of the end cap member 32 is urged into engagement within the associated opening in the bottom wall of the second tubular stage member 14*b*, locking the first stage tubular member 14*a* in its extended position. In the fully extended state of each tubular actuator assembly 14, as seen in FIGS. 1 and 2, this engagement of the locking pin 34 is repeated in each successive stage by the similar interaction and operative engagement of the spring-loaded locking pin chambered within each of the respective end cap assemblies 40, 50 and 60 with the associated openings in the respective tubular members 14*c*, 14*d* and 15.

Figure 4:
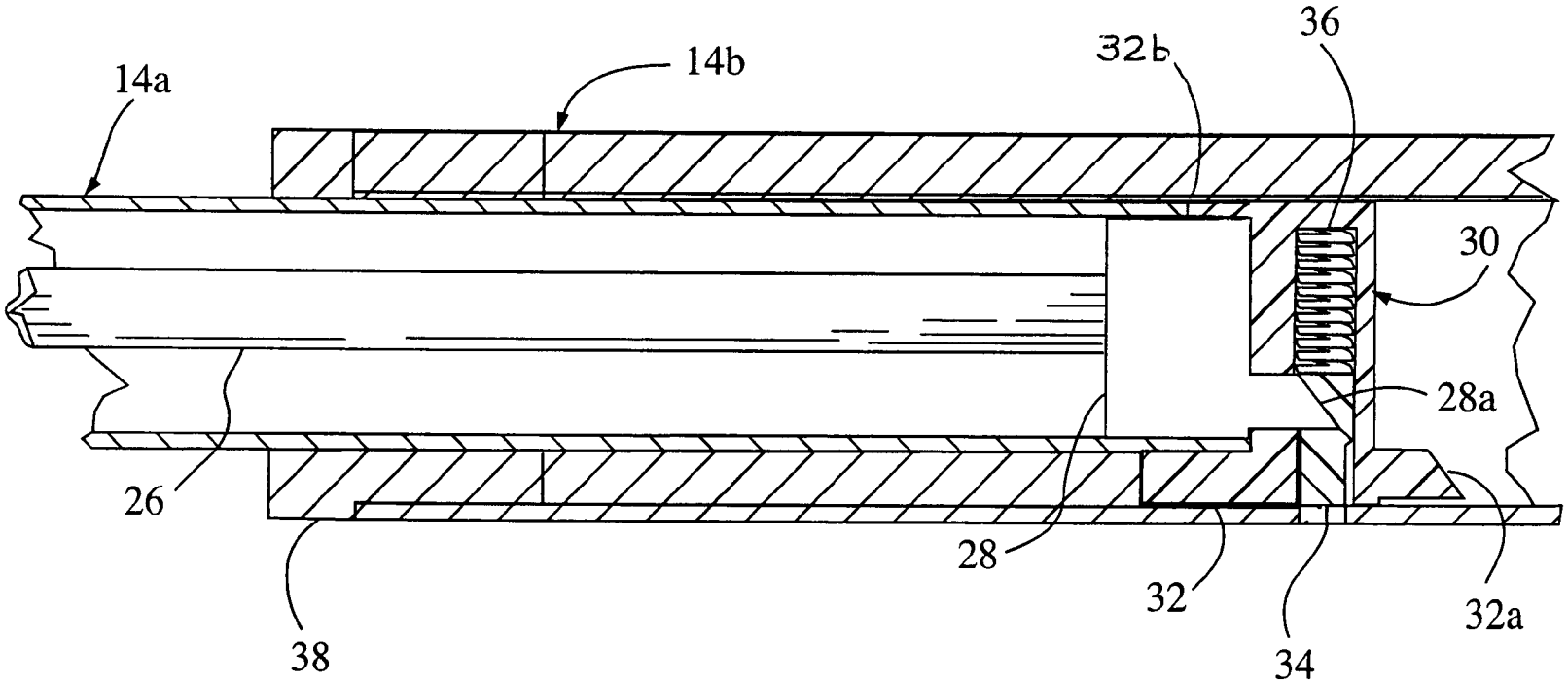
FIG. 4 is a longitudinal view partially sectioned and cut away of the internal engagement of the first and second stages of the tubular actuator assembly during manual retraction in accordance with the present invention.

Referring now to FIG. 4 in conjunction with FIG. 2*a*, unlocking of the respective stages of the extended tubular actuator assemblies 14 and the progressive retraction of the present boat shade system 10 is initiated by pushing the actuator lever 24 rearward in slot 24*a* on each side of the extended framework thereby moving the unlocking members 28 rearward in the respective chambers of the first stage tubular member 14*a* on each side via the respective actuator shaft 26 therein. When the unlocking lever 28 is activated and pressed rearward into motion, the extended post 28*a* will engage the slot opening in the forward wall of the end cap member 32 and engage with the angled cutout section 34*a* on the spring-loaded locking pin 34 to force the pin upward into the vertical chamber 32*c* against the compression spring 36 sufficiently to release the pin from engagement with the associated hole opening in the bottom of the second stage tubular member 14*b*. This effectively unlocks the first stage member 14*a* from the second stage member 14*b* and allows them together, if desired, to continue rearward, retracting through the third stage tubular member 14*c* on each side of the framework using pushing forces applied to the handle bar 18. Otherwise, a partial retraction of the tubular actuator assemblies 14 affecting only the first stage tubular members 14*a* will be the resultant as the remaining tubular stages 14*b*, 14*c* and 14*d* will remain locked and extended form the stationary tubular member 15 on each side. With continued pushing forces applied to the handle bar 18, each successive tubular stage will be unlocked in progression by means of the pushing movement of the respective end cap posts 32*a*, 42*a*, and 52*a* on the second, third and fourth tubular stages 14*b*, 14*c* and 14*d* rearward through the remaining stages and into operative engagement with the cutout section 34*a* on each spring-loaded locking pin 34 chambered in the respective end cap assemblies 40, 50 and 60. In this progressive manner, the latter extended stages will stay locked in place until each prior stage comes to a fully retracted position which will then trigger the next stage to retract and so on. The benefit of having each stage staying locked until being triggered to unlock by retraction is that it will prevent the user from racking the shade by pushing one side more than the other. With operating one stage at a time, the user can focus on proper pressure and correct accordingly without all the other stages adding too much pressure to one side or the other.

Figure 5:
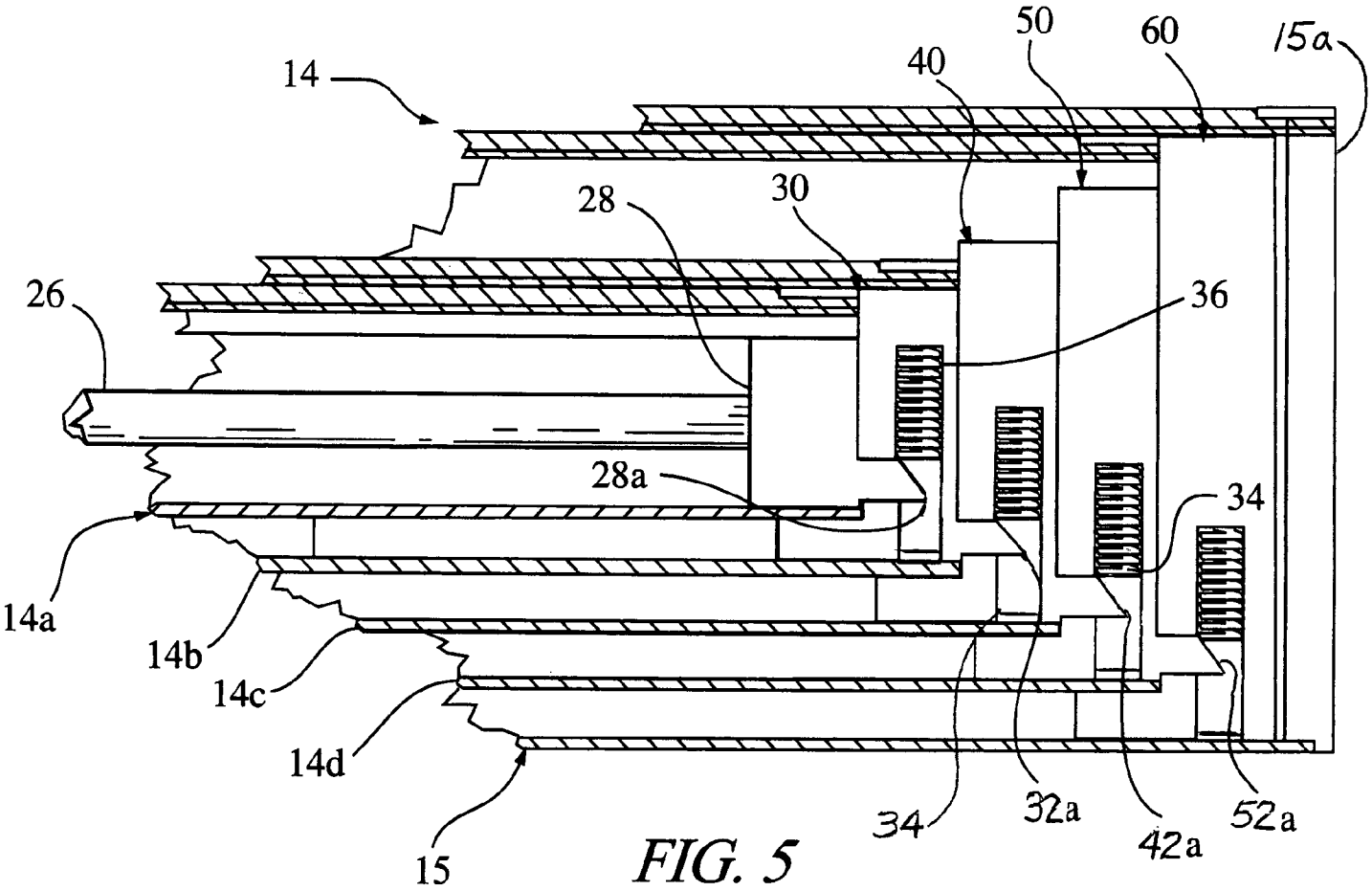
FIG. 5 is an enlarged longitudinal view partially sectioned and cut away showing the back end of the tubular actuator assembly of the present boat shade system when fully retracted.

As shown in FIG. 5, the fully retracted tubular actuator assembly 14 will have each of the spring-loaded locking pins 34 retracted within the respective chamber 32*c* of each of the end cap assemblies 30, 40, 50 and 60. In this fully retracted state of the present boat shade system 10 effected completely by hand, all of the tubular stages 14*a*-14*d* have been moved completely rearward within each other and are substantially contained within stationary tubular member 15 with the sheet of canvas material 12 being substantially withdrawn back upon the tensioned roller member 20.

Therefore, it is apparent that the described invention provides an improved retractable shade system for boats that is simple to operate completely by hand and easily installed upon a variety of boats to furnish extended sunshade protection to those on board the boat without causing obstructions upon the deck. The present pullout shade system is especially suited for smaller recreational boats and is lightweight and completely manual in its operation without motors or cranks and easy to deploy whenever extended sunshade protection is needed and without obstructing the movement or performance of those on or around the deck. The present pullout boat shade system is self-supporting in its assembled structure and readily mountable to any overhead structure that may exist or be erected upon the deck of the boat to provide needed sunshade protection to those on board. The present pullout boat shade system with its self-engaging and releasable locking arrangement is safe and reliable to use regardless of whether the boat is resting in calm water or moving about on high seas, and is relatively inexpensive to make, assemble and install in an integrated working unit affordable to a substantial number of boat owners.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, alternate tubing shapes for the tubular members 14*a*-14*d* and 15, such as oval and square tubing, may be used rather than round tubing and not require a guide rail or the like, as described above, within the telescopic actuator assemblies 14. Further, the tensioned roller member 20 may alternatively be mounted transversely at the front end of the first stage tubular member 14*a* at the position of the forward crossbar 17 rather than at the opposite end of the tubular assembly framework at the position of the stationary tubular member 15 and thus deploy the canvas material 12 in a reverse fashion by hand. As another example, the sheet of canvas material 12 of the present boat shade system 10 may be further adapted to hold loop attachments along its bottom surface, as shown and described in my pending U.S. patent application Ser. No. 13/134,057 now published as US-2011-0290170-A1, with the loops being positioned to engage tabs formed on the intermediate crossbar 16 to prevent billowing of the canvas material when fully deployed. Accordingly, it is understood that this invention is not limited to the particular embodiment described, but rather is intended to cover modifications within the spirit and scope of the present invention as expressed in the appended claims.

What is claimed is:

1. A retractable shade system for manual deployment upon a boat, comprising:

a canvas material;

a longitudinal roller member for storing a length of said canvas material under tension;

a pair of tubular assemblies each comprising a plurality of tubular members, each tubular member having a respective chamber therein extending between a forward and a rearward end thereof and being further fitted together and assembled for telescopic movement between a fully retracted and a fully extended configuration, said tubular assemblies being aligned in parallel and disposed on opposite sides of said longitudinal roller member in operative connection with said canvas material; and releasable locking means operatively connected and fitted within each of said tubular assemblies for providing a staged telescopic movement of the respective tubular members so that said tubular assemblies are selectively locked and unlocked in a succession of predetermined stages between the fully extended and fully retracted configurations, said releasable locking means comprising a first lever member releasably engaged within the chamber of each of said tubular members at a forward end thereof and adapted to move rearward within the chamber; a shaft operatively connected at one end thereof to said first lever member and adapted to extend to an opposite end thereof rearward through the chamber of each tubular member; a second lever member attached to the opposite end of the shaft and formed having an extended post with an angled, wedge-like surface projecting rearward therefrom; and end cap means secured within the chamber at the rearward end of each tubular member and adapted to engage the extended post of said second lever member for releasing the telescopic movement of each of said tubular members as the extended post is engaged.

2. A retractable boat shade system according to claim 1, further comprising:

a bar member transversely mounted between said tubular assemblies and operatively connected to the tubular members at the forward end thereof for moving said tubular assemblies manually between the fully extended and retracted configurations.

3. A retractable boat shade system according to claim 1, wherein said end cap means comprises:

an end cap member provided with a chamber vertically formed therethrough and a substantially horizontal slot opening formed on a forward surface thereof and made to extend through to the vertical chamber to allow passage of the extended post of said second lever member to and from the vertical chamber, said end cap member further having an extended post with an angled wedge-like surface projecting from the rearward surface thereof; and spring-loaded locking pin means normally biased to engage the respective tubular members through the vertical chamber of said end cap member and adapted to move in disengagement from each of the respective tubular members upon passage of the extended post of said second lever member into the vertical chamber.

4. A retractable boat shade system according to claim 3, wherein said spring-loaded locking pin means comprises:

a locking pin member sized to fit within the vertical chamber and formed having an angled cutout section along its length conforming to the angled, wedge-like surface projecting from the extended post of said second lever member to permit cooperative engagement therewith; and a compression spring sized to fit within the vertical chamber and positioned to engage said locking pin so that said pin is normally urged downward and outward from the vertical chamber.

5. A retractable boat shade system according to claim 2, further comprising:

an intermediate cross bar transversely connected between said tubular assemblies to support the tubular members and said canvas material between fully retracted and fully extended configurations.

6. A retractable boat shade system according to claim 5, further comprising:

a plurality of sleeve members each fitted within the respective chambers of the tubular members and attached thereto to stabilize the telescopic movement of the tubular members.

7. A retractable shade system for manual deployment upon a boat, comprising:

a canvas material;

a longitudinal roller member for storing a length of said canvas material under tension;

tubular actuator means operatively connected to said roller member for moving said canvas material and adapted for telescopic movement between a fully retracted and a fully extended configuration, said tubular actuator means comprising a pair of tubular assemblies each comprising a plurality of tubular members having chambers fitted coaxially together and adapted to move telescopically in multiple stages between a retracted and extended state, said tubular assemblies being aligned in parallel and disposed on opposite sides of said longitudinal roller member in operative connection with said canvas material; and releasable locking means operatively connected to said tubular actuator means for providing a staged telescopic movement thereof so that said tubular actuator means is selectively locked and unlocked in a succession of predetermined stages between the fully extended and fully retracted configurations, said releasable locking means comprising a first lever member releasably engaged within the chamber of each of said tubular members at a forward end thereof and adapted to move rearward within the chamber; a shaft operatively connected at one end thereof to said first lever member and adapted to extend rearward through the chamber of each tubular member; a second lever member attached to the opposite end of the shaft and formed having an extended post with an angled, wedge-like surface projecting rearward therefrom; and end cap means secured within the chamber at the rearward end of each tubular member and adapted to engage the extended post of said second lever member for releasing the telescopic movement of each of said tubular members as the extended post is engaged.

8. A retractable boat shade system according to claim 7, wherein said end cap means comprises:

an end cap member provided with a chamber vertically formed therethrough and a substantially horizontal slot opening formed on the forward surface thereof and made to extend through to the vertical chamber to allow passage of the extended post of said second lever member to and from the chamber, said end cap member further having an extended post with an angled wedge-like surface projecting from the rearward surface thereof; and spring-loaded locking pin means normally biased to engage the tubular member through the vertical chamber of said end cap member and adapted to move in disengagement from the tubular member upon passage of the extended post of said second lever member into the vertical chamber.

9. A retractable boat shade system according to claim 8, wherein said spring-loaded locking pin means comprises:

a locking pin member sized to fit within the vertical chamber and formed having an angled cutout section along its length conforming to the angled, wedge-like surface projecting from the extended post of said second lever member to permit cooperative engagement therewith; and a compression spring sized to fit within the vertical chamber and positioned to engage said locking pin so that said pin is normally urged downward and outward from the vertical chamber.

10. A retractable boat shade system according to claim 7, further comprising:

a plurality of sleeve members each fitted within the respective chambers of the tubular members and attached thereto to stabilize the telescopic movement of the tubular members.

11. A retractable boat shade system according to claim 7, further comprising:

a handle bar member operatively connected to said tubular actuator means for moving said canvas material manually through the succession of predetermined stages of the telescopic movement.

12. A retractable boat shade system according to claim 11, further comprising:

an intermediate cross bar transversely connected between said tubular assemblies to support the tubular members and said canvas material between fully retracted and fully extended configurations.

* * * * *